US012503873B2

(12) United States Patent
Hobaica

(10) Patent No.: US 12,503,873 B2
(45) Date of Patent: Dec. 23, 2025

(54) MODULAR PLUNGE POOL

(71) Applicant: Plunge Pool Concepts, Inc., South Easton, MA (US)

(72) Inventor: David E. Hobaica, Mansfield, MA (US)

(73) Assignee: Plunge Pool Concepts, Inc., South Easton, MA (US)

( * ) Notice: Subject to any disclaimer, the term of this patent is extended or adjusted under 35 U.S.C. 154(b) by 91 days.

(21) Appl. No.: 18/640,314

(22) Filed: Apr. 19, 2024

(65) Prior Publication Data

US 2025/0327323 A1 Oct. 23, 2025

(51) Int. Cl.
*E04H 4/00* (2006.01)

(52) U.S. Cl.
CPC ..... *E04H 4/0093* (2013.01)

(58) Field of Classification Search
CPC ..... E04H 4/0093
USPC ..... 4/488, 506–509
See application file for complete search history.

(56) References Cited

U.S. PATENT DOCUMENTS 3,596,296 A 8/1971 Gertz et al.
3,824,751 A 7/1974 Shelander
3,975,782 A * 8/1976 Lankheet ..... E04H 4/142 4/506
4,015,383 A 4/1977 Crowley
4,858,411 A * 8/1989 Graham ..... E04H 4/0087 52/745.1
5,114,274 A 5/1992 Heiler, Jr.
6,637,162 B1 10/2003 Holland
6,854,223 B1 2/2005 Holland
8,028,353 B1 * 10/2011 Hohmann, Jr. ..... B32B 5/32 428/317.1
8,336,263 B2 12/2012 Schultz et al.
8,869,469 B2 10/2014 Ludlow et al.
11,505,958 B2 11/2022 Hobaica et al.
2003/0051432 A1 3/2003 Haberler
2015/0337551 A1 11/2015 Romano
2019/0365602 A1 12/2019 Selinger
2022/0186511 A1 6/2022 Hobaica et al.
2022/0316227 A1 * 10/2022 Hermans ..... E04H 4/0031
(Continued)

FOREIGN PATENT DOCUMENTS

AT 507841 B1 10/2010
AT 14111 U1 4/2015
(Continued)

OTHER PUBLICATIONS

International Search Report for PCT Application No. PCT/US2025/022709 mailed May 16, 2025.

*Primary Examiner* — Lori L Baker
(74) *Attorney, Agent, or Firm* — Lando & Anastasi, LLP

(57) ABSTRACT

A modular plunge pool includes a precast base unit having a bottom wall with a first top surface and at least one stepped wall provided on a periphery of the bottom wall. The at least one stepped wall has a second top surface disposed above the first top surface of the bottom wall a predetermined distance. The modular plunge pool further includes a precast riser unit separate from the precast base unit. The precast riser unit has at least one wall that extends vertically. The precast riser unit, when secured to the precast base unit, is configured so that the at least one wall of the precast riser unit is inboard with respect to the at least one stepped wall of the precast base unit.

20 Claims, 7 Drawing Sheets

(56) References Cited

U.S. PATENT DOCUMENTS

| | | | | |
|---|---|---|---|---|
| 2023/0067953 | A1 | 3/2023 | Hobaica et al. | |
| 2023/0083381 | A1* | 3/2023 | Hobaica | E04H 4/144<br>4/507 |

FOREIGN PATENT DOCUMENTS

| | | | |
|---|---|---|---|
| CN | 109519004 | A | 3/2019 |
| DE | 1955078 | A1 | 5/1971 |
| DE | 102012021795 | A1 | 5/2014 |
| ES | 2298037 | A1 | 5/2008 |
| FR | 2248734 | A5 | 5/1975 |
| FR | 2689552 | A1 | 10/1993 |
| FR | 2812323 | A1 | 2/2002 |

* cited by examiner

MODULAR PLUNGE POOL

BACKGROUND OF DISCLOSURE

The present disclosure relates generally to swimming pools, including in-ground swimming pools, and more particularly to a modular plunge pool configured to be installed in a finished or nearly finished condition.

Plunge pools have become a popular alternative to traditional swimming pools. A typical plunge pool is a smaller than a swimming pool and suitable for smaller yards or outdoor spaces. A plunge pool can vary in shape and size, and can be constructed to be in-ground, above-ground, or in between. A plunge pool can be between 75 and 400 square feet in area and three to five feet deep, with a traditionally flat bottom.

SUMMARY OF DISCLOSURE

One aspect of the present disclosure is directed to a modular plunge pool comprising a precast base unit including a bottom wall having a first top surface and at least one stepped wall provided on a periphery of the bottom wall. The at least one stepped wall has a second top surface disposed above the first top surface of the bottom wall a predetermined distance. The modular plunge pool further comprises a precast riser unit separate from the precast base unit. The precast riser unit has at least one wall that extends vertically. The precast riser unit, when secured to the precast base unit, is configured so that the at least one wall of the precast riser unit is inboard with respect to the at least one stepped wall of the precast base unit.

Embodiments of the modular plunge pool further may include an adhesive positioned on the first top surface of the precast base unit where the precast riser unit is secured. The adhesive may be butyl tape. The modular plunge pool further may include at least one fastener configured to secure the at least one wall of the precast riser unit to the stepped wall of the precast base unit. The at least one fastener may include a length of angle iron secured to the second top surface of the at least one stepped wall of the precast base unit and an outwardly facing surface of the at least one wall of the precast riser unit. The at least one stepped wall of the precast base unit may include three stepped walls and the at least one wall of the precast riser unit may include three walls, with the three stepped walls of the precast base unit corresponding to the three walls of the precast riser unit. The modular plunge pool further may include an adhesive positioned on the first top surface of the precast base unit where the three walls of the precast riser unit are secured. The adhesive may be butyl tape. The modular plunge pool further may include a plurality of fasteners configured to secure the three walls of the precast riser unit to the respective three stepped walls of the precast base unit. The plurality of fasteners each may include, for each stepped wall of the precast base unit and the respective wall of the precast riser unit, a length of angle iron secured to the second top surface of the stepped wall of the precast base unit and an outwardly facing surface of the respective wall of the precast riser unit. The precast riser unit further may include a horizontal shelf secured to side walls of the three walls of the precast riser unit, with the horizontal shelf being disposed above the top surface of the bottom wall of the precast base unit a predetermined distance.

Another aspect of the present disclosure is directed to a method of assembling the modular plunge pool. In one embodiment, the method comprises: delivering the precast base unit and the precast riser unit to an installation site; positioning the precast base unit at the installation site; and securing the precast riser unit to the precast base unit so that the precast base unit and the precast riser unit define an interior of the modular plunge pool.

Embodiments of the method further may include installing adhesive on the precast base unit on the top surface of the precast base unit where the precast riser unit is positioned. The method further may include depositing grout in a space provided between the at least one wall of the precast riser unit and the at least one stepped wall of the precast base unit. The method further may include securing at least one length of angle iron to the precast base unit and the precast riser unit at a desired location. The method further may include installing equipment under a horizontal shelf of the precast riser unit.

Yet another aspect of the present disclosure is directed to a modular plunge pool and hot tub, comprising a precast base unit including a bottom wall having a first top surface and at least one stepped wall provided on a periphery of the bottom wall. The at least one stepped wall has a second top surface disposed above the first top surface of the bottom wall a predetermined distance. The modular plunge pool and hot tub further comprises a precast riser pool unit separate from the precast base unit. The precast riser pool unit has at least one plunge pool wall that extends vertically. The modular plunge pool and hot tub further comprises a precast riser hot tub pool unit separate from the precast base unit and the precast plunge pool unit. The precast hot tub unit has at least one hot tub wall that extends vertically. Each of the precast riser pool unit and the precast riser hot tub unit, when secured to the precast base unit, is configured so that the at least one plunge pool wall of the precast riser pool unit and the at least one hot tub wall of the precast riser hot tub unit are inboard with respect to the at least one stepped wall of the precast base unit.

Embodiments of the modular plunge pool and hot tub further may include an adhesive positioned on the first top surface of the precast base unit where the precast riser pool unit and the precast riser hot tub unit are secured. The adhesive may be butyl tape. The modular plunge pool and hot tub further may include at least one fastener configured to secure the at least one wall of the precast riser unit to the stepped wall of the precast base unit. The at least one fastener may include a length of angle iron secured to the second top surface of the at least one stepped wall of the precast base unit and an outwardly facing surface of the at least one wall of the precast riser unit. The at least one stepped wall of the precast base unit may include four stepped walls, the at least one plunge pool wall of the precast riser pool unit may include four plunge pool walls, at least three stepped walls of the four stepped walls of the precast base unit corresponding to at least three plunge pool walls of the four plunge pool walls of the precast riser pool unit, and the at least one hot tub wall of the precast riser hot tub unit may include four hot tub walls, with at least three stepped walls of the four stepped walls of the precast base unit corresponding to at least three hot tub walls of the four hot tub walls of the precast riser hot tub unit. The modular plunge pool and hot tub further may include an adhesive positioned on the first top surface of the precast base unit where the at least three plunge pool walls of the precast riser pool unit and the at least three hot tub walls of the precast riser hot tub unit are secured. The modular plunge pool and hot tub further may include a plurality of fasteners configured to secure the at least three plunge pool walls of the precast riser pool unit to the respective three stepped walls of the precast base unit and to secure the at least three hot tub walls of the precast hot tub unit to the respective three stepped walls of the precast base unit.

Another aspect of the present disclosure is directed to a method of assembling the modular plunge pool and hot tub. In one embodiment, the method comprises: delivering the precast base unit, the precast riser pool unit and the precast riser hot tub unit to an installation site; positioning the precast base unit at the installation site; securing the precast riser pool unit to the precast base unit so that the precast base unit and the precast riser unit define an interior of the modular plunge pool; and securing the precast riser hot tub unit to the precast base unit so that the precast base unit and the precast riser hot tub unit define an interior of the modular hot tub.

Embodiments of the method further may include installing adhesive on the precast base unit on the top surface of the precast base unit where the precast riser pool unit and the precast riser hot tub unit are positioned. The method further may include depositing grout in spaces provided between the at least one plunge pool wall of the precast riser pool unit and the at least one stepped wall of the precast base unit and the at least one hot tub wall of the precast riser hot tub unit and the at least one stepped wall of the precast base unit. The method further may include securing at least one length of angle iron to the precast base unit and the precast riser pool unit at a desired location, and securing at least one length of angle iron to the precast base unit and the precast riser hot tub unit at a desired location.

BRIEF DESCRIPTION OF DRAWINGS

The accompanying drawings are not intended to be drawn to scale. In the drawings, each identical or nearly identical component that is illustrated in various figures is represented by a like numeral. For purposes of clarity, not every component may be labeled in every drawing. In the drawings.

DETAILED DESCRIPTION

Figure 2:
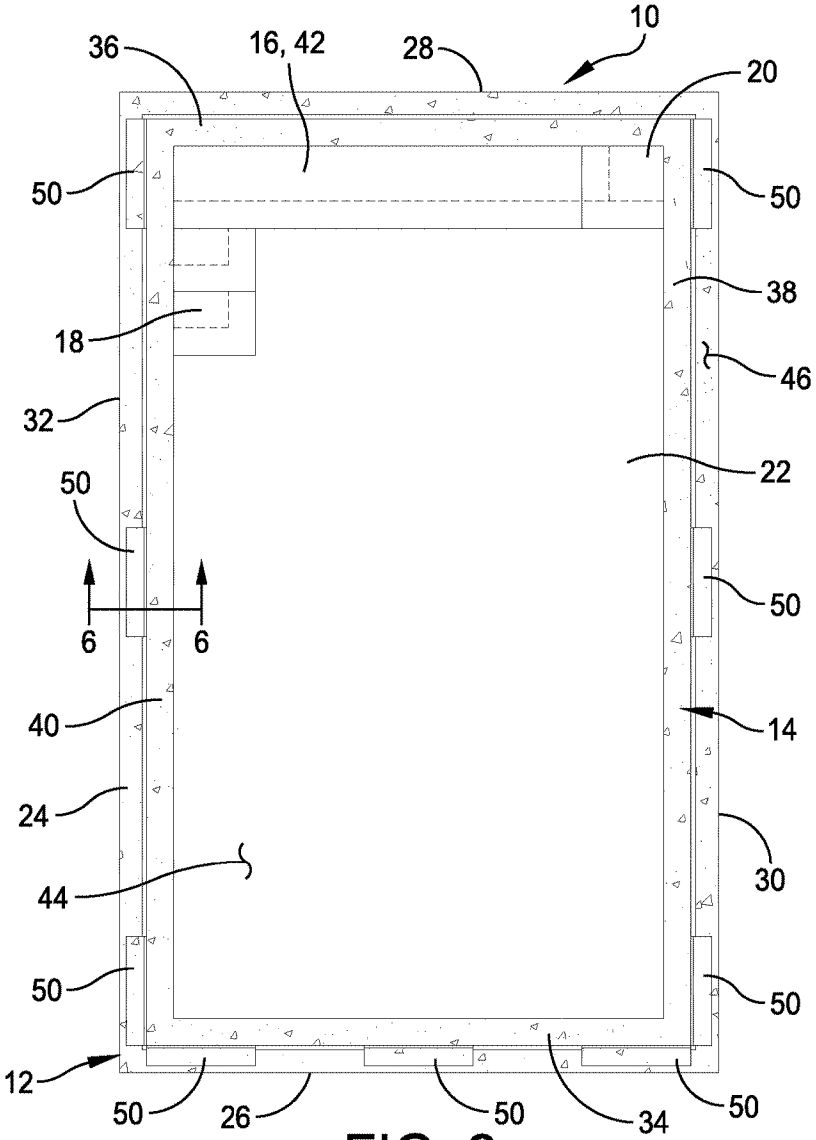
FIG. 2 is a top plan view of the modular plunge pool.

This disclosure is not limited in its application to the details of construction and the arrangement of components set forth in the following description or illustrated in the drawings. The disclosure is capable of other embodiments and of being practiced or of being carried out in various ways. Also, the phraseology and terminology used herein is for the purpose of description and should not be regarded as limiting. The use of "including," "comprising," "having," "containing," "involving," and variations thereof herein, is meant to encompass the items listed thereafter and equivalents thereof as well as additional items.

The present disclosure relates to pools, particularly modular plunge pools. In some embodiments, the modular plunge pools are in-ground swimming pools. In other embodiments, the modular plunge pools are above-ground swimming pools. And in other embodiments, the modular plunge pools are hybrids of in-ground and above-ground swimming pools. The plunge pools that are known in the art are typically in the range of six feet to ten feet wide and no more than 20 feet in length. The primary advantages of this style of pool are lower cost, ease and speed of installation. These pools are typically made of reinforced concrete, steel panels, or fiberglass and can be surfaced with several different materials. In some embodiments, each pool has a bottom wall and four side walls. This size of pool goes by several names, such as "cocktail pool," "spool," "garden pool," and other names.

A modular plunge pool made of concrete has structural advantages over pools that are not made of concrete. However, typical concrete pool construction involves several time-consuming and costly steps. Some concrete pools are precast, monolithic pools that are built and poured offsite and then transported to the site and set using a crane or boom truck. However, most monolithic pools are installed using a crane, which is not suitable for installing a pool in some locations because of local buildings, terrain features, or other obstacles. Because of the weight of the monolithic pool, a sufficiently powerful crane must be used and at a significant cost.

In addition to enabling rigid manufacturing standards, the present disclosure provides a modular plunge pool and a method for installing a modular plunge pool that saves a considerable amount of time and labor relative to previously known methods of installing a pool.

In some embodiments, the modular plunge pool of the present disclosure includes a plurality of concrete modules that are precast. In some embodiments, the precast modules of the modular plunge pool are made in a factory setting to exacting manufacturing standards. The precast modules are then loaded on a flatbed truck, delivered to the installation site, and assembled piece by piece using a crane or boom truck.

In some embodiments, the two primary modules of the modular plunge pool are a concrete precast base unit and a concrete precast riser unit. The precast base unit defines a bottom wall of the pool, and the precast riser unit defines at least one side wall of the pool. In some embodiments, at least one side wall defined by the precast riser unit is four side walls of the pool. By separating the modular plunge pool into two modules instead of one monolithic pool, the modular plunge pool can be loaded, transported, and installed on site without the use of a crane (unless there is not enough access for a boom truck) saving considerable time and money on installation.

In some embodiments, the precast modules include internal structures for the pool. For example, the internal structures can include one or more benches and/or one or more sets of step risers that are configured to be placed on the base of the pool. Once the precast riser unit is set on the precast base unit, the precast benches and steps are then set in place. These modules and method of installation saves considerable time, labor, and materials relative to the previously known method of building these interior features using cement blocks. These modules and method of installation enable the plunge pool to be more customizable than other similar pools.

In some embodiments, the precast modules also include precast concrete panels that attach to the exterior of the precast riser unit of the pool when the pool is designed to be sitting above grade by 16"-18". Stone veneer is applied to the panels in a factory setting and the panels are shipped to the job site with the pool and the other precast modules. The precast panels and pre-application of the stone veneer saves a considerable amount of time and labor versus the prior known method of doing the work in the field where it is subject to the uncertainty of the weather.

In some embodiments, the precast modules also include precast "vaults" that are used to house the mechanism for an automatic cover. These precast "vaults" are made in a factory setting to exacting standards and are shipped to the site with the pool and other precast modules. The "vault" is then lowered into place with a boom truck or crane and attached to the side of the riser wall.

Because the individual modules of the pool are much lower in weight than a monolithic pool for a given pool interior volume, the modular plunge pool of the present disclosure enables significantly larger pools to be easily transported and installed without the use of a crane (unless the installation crew cannot access the site with the boom truck). As a result, modular plunge pools of the present disclosure can be significantly larger than previously known monolithic precast concrete pools (9 feet×21 feet vs 7 feet×13 feet) and do not typically require the use of a specialized crane. For example, an embodiment of a modular plunge pool of the present disclosure having an inner footprint of 9 feet by 21 feet (outer footprint of 10 feet by 22 feet) can be installed with a boom truck, and without use of a specialized crane. Also, the modular design of the step inserts, benches, wall panels, and automatic cover vaults save significant time, labor, and materials over the alternative which is to build them using concrete blocks and mortar on-site.

Figure 1:
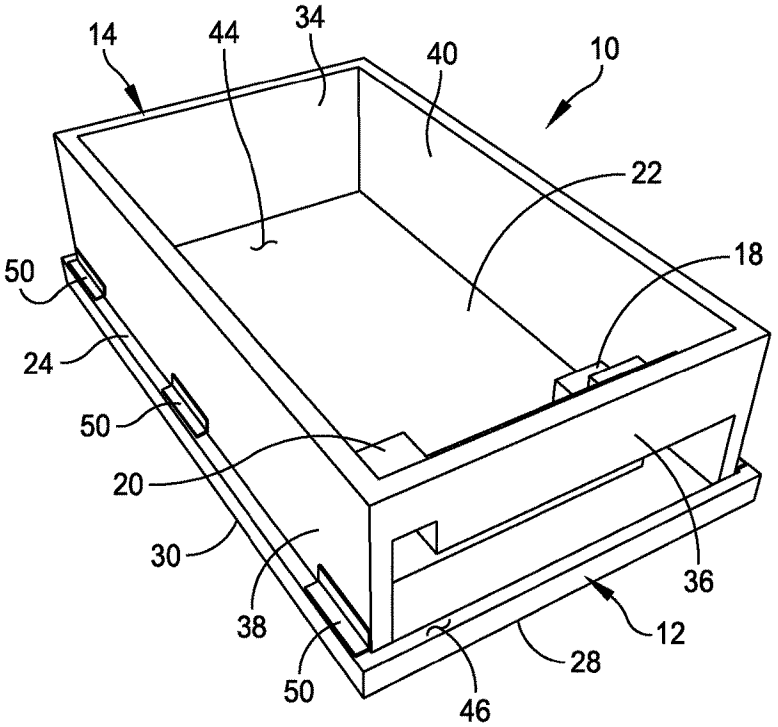
FIG. 1 is a perspective view of a modular plunge pool of an embodiment of the present disclosure.

For purposes of illustration, and with reference to FIG. 1, an embodiment of the present disclosure will now be described with reference to a modular plunge pool, generally indicated at 10, which can be subsequently lined, such as with a vinyl liner, frost-proof tile, or plaster, and used to contain water in which humans can swim. The modular plunge pool 10 can be placed at least partially in-ground at a site, such as a backyard of a residential property.

The modular plunge pool 10 includes a precast base unit, generally indicated at 12, and a precast riser unit, generally indicated at 14, that is supported on the precast base unit 12. Together the precast base unit 12 and the precast riser unit 14 define an interior volume of the modular plunge pool 10, which is configured to serve as a reservoir for containing water. Within the interior volume of the modular plunge pool 10, a variety of modular internal structures can be placed on the precast base unit 12. With additional reference to FIG. 2, the internal structures may include a bench 16, a double step 18, and a top step 20 supported on the bench. Each of the internal structures can be either precast or formed at the site, but preferably precast with the precast riser unit 14.

Figure 4:
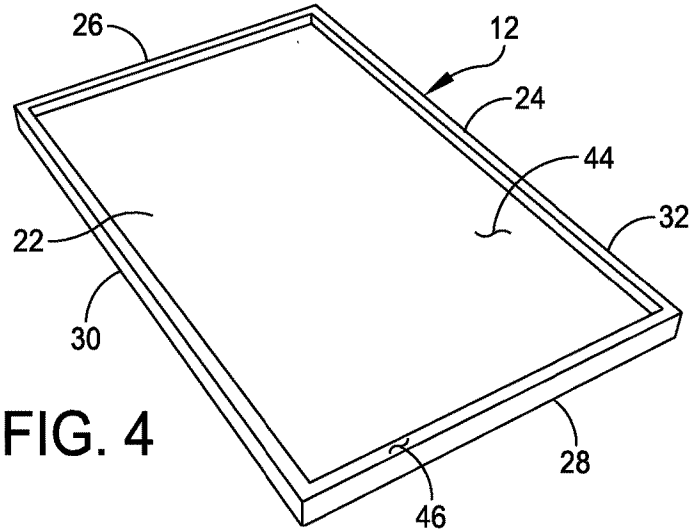
FIG. 4 is a perspective view of a bottom tray of the modular plunge pool.
Figure 5:
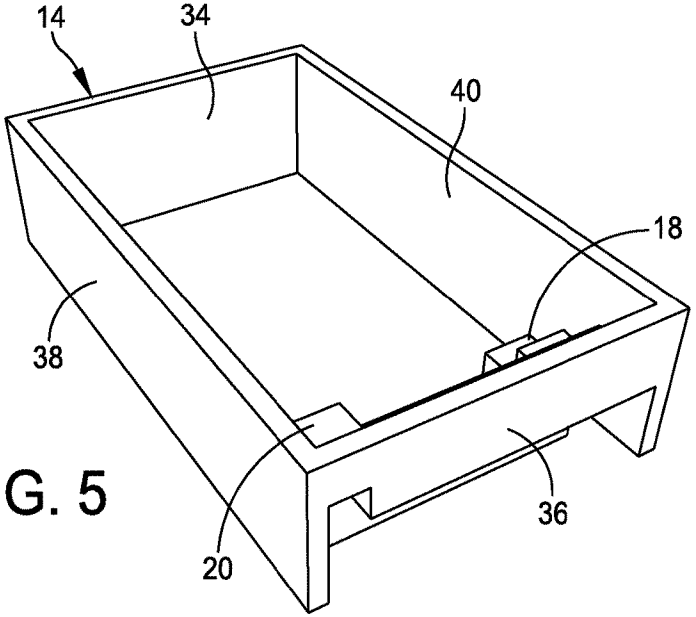
FIG. 5 is a perspective view of a riser of the modular plunge pool.
Figure 3:
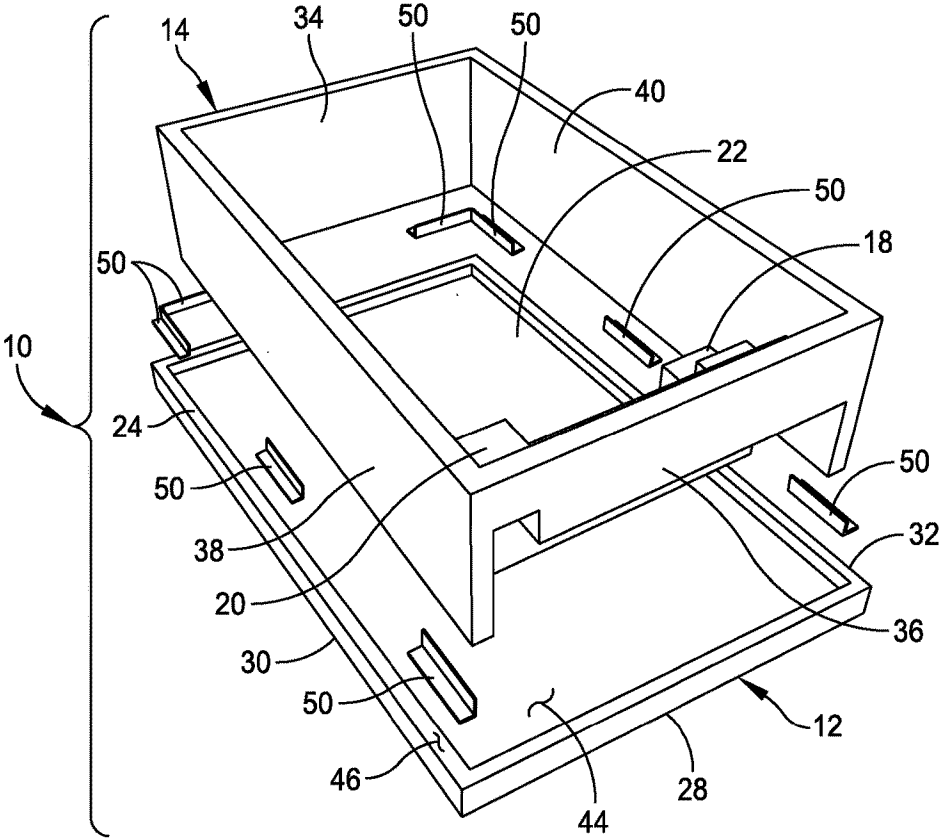
FIG. 3 is an exploded perspective view of the modular plunge pool.

Referring additionally to FIGS. 3-5, the precast base unit 12 includes a bottom wall 22 that is generally planar. Referring particularly to FIGS. 2 and 4, the precast base unit 12 further includes a stepped wall 24 that extends above the bottom wall 22. The size and shape of the precast base unit 12 defines the area (width and length) of the modular plunge pool 10. In one embodiment, the precast base unit 12 includes two ends 26, 28 and two longer sides 30, 32. In the shown embodiment, each end 26, 28 is eleven feet wide and each side 30, 32 is eighteen feet long. However, the width and length of the precast base unit 12 can be selected based on a number of factors, including the area available for installation. In one embodiment, the bottom wall 22 has a thickness of six inches and the stepped wall 24 has a thickness of five inches. As noted, the thicknesses of the bottom wall 22 and the stepped wall 24 can be tailored to meet design needs.

Referring particularly to FIGS. 2 and 5, the precast riser unit 14 is sized and shaped to fit within the stepped wall 24 of the precast base unit 12. Specifically, the precast riser unit 14 is sized and shaped to fit within the interior boundary defined by inner surfaces of the stepped wall 24 of the precast base unit 12. In one embodiment, the precast riser unit 14 includes a solid end wall 34, an opposite end wall 36, and two longer side walls 38, 40. In the shown embodiment, the opposite end wall 36 is configured to have a horizontal shelf 42 formed therein. In the shown embodiment, the bench 16 constitutes the horizontal shelf 42, which is secured to side walls 38, 40, with the horizontal shelf 42 being disposed above the bottom wall 22 of the precast base unit 12. As mentioned above, the precast riser unit 14 is designed to fit within the stepped wall 24 of the precast base unit 12. In the shown embodiment, each end wall 34, 36 has a width of slightly less than ten feet and each side wall has a length of slightly less than seventeen feet. In one embodiment, the end wall 34 and the side walls 38, 40 each have an inwardly facing surface and an outwardly facing surface, with a thickness of six inches. The construction of the horizontal shelf 42 of the end wall 36 will be described in greater detail below.

The modular plunge pool 10 is installed at a site by placing the precast base unit 12 in a hole that is dug into an area of ground at the intended installation site. The precast base unit 12 sits on the ground surface at a bottom of the hole. As shown, the precast base unit 12, in one embodiment, is rectangular in shape, having a length and width that are slightly larger than a length and width of the precast riser unit 14. When positioned, the precast riser unit 14 is placed on top of the precast base unit 12. As will be described in greater detail below, a seal is formed between the precast base unit 12 and the precast riser unit 14 so that the precast base unit 12 and the precast riser unit 14 together define the interior volume of the modular plunge pool 10 with an open upper end. In some embodiments, the interior volume is in the shape of a rectangular void.

In one embodiment, as mentioned above, a liner (not shown), such as a liner made of vinyl, tile, or plaster, can be placed within the interior volume of the modular plunge pool 10 so that the liner covers a top surface 44 of the bottom wall 22 of the precast base unit 12, the inner surfaces of the end walls 34, 36 and the side walls 38, 40 of the precast riser unit 14, and the internal structures, e.g., the bench 16, the double step 18, and the top step 20, that were placed within the interior volume of the modular plunge pool 10. One advantage of the module plunge pool 10 of embodiments of the present disclosure is that the liner can be prefabricated with the other components of the modular plunge pool 10 prior to installation.

Figure 6:
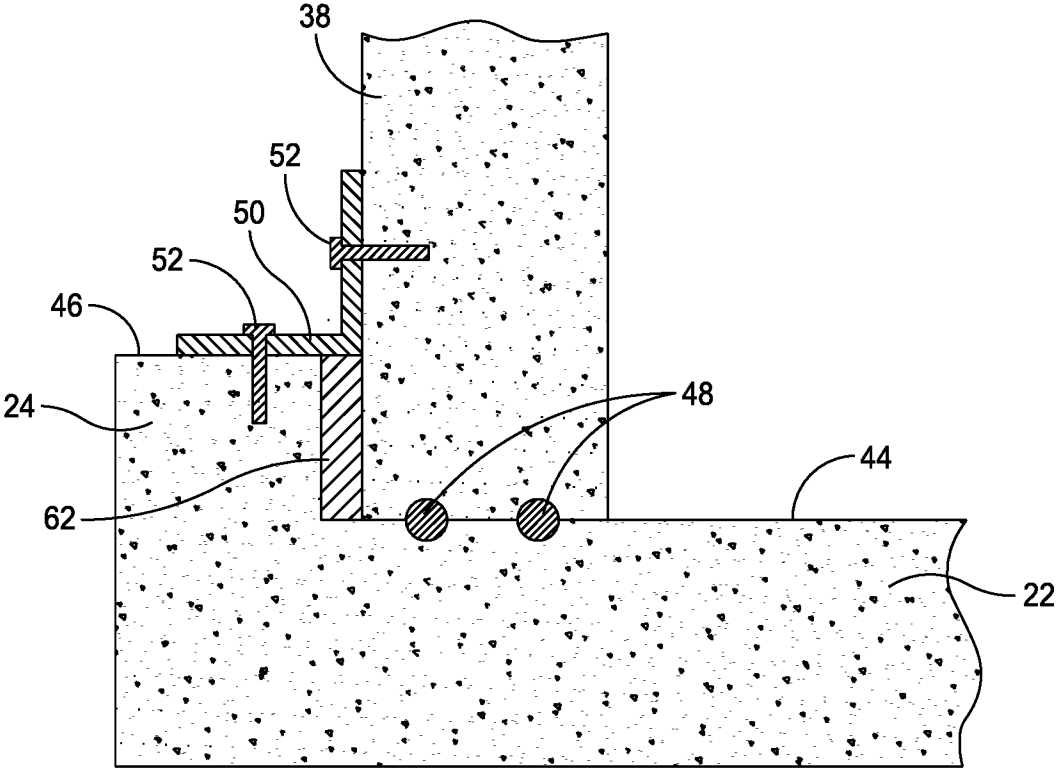
FIG. 6 is a cross-sectional view of a portion of the modular plunge pool.

Referring to FIG. 6, the manner in which the precast riser unit 14 is secured to the precast base unit 12 is shown. As described above, the precast base unit 12 includes the bottom wall 22 having the top surface 44 on which the precast riser unit 14 is received. The precast base unit 12 further includes the peripheral stepped wall 24 that extends upwardly from the bottom wall 22 around the periphery of the bottom wall, e.g., ends 26, 28 and sides 30, 32. As shown, the stepped wall 24 includes a top surface 46 that extends above the top surface 44 of the bottom wall 22. In one embodiment, the top surface 46 of the stepped wall 24 is four inches above the top surface 44 of the bottom wall 22.

In one embodiment, the precast riser unit 14 is positioned on the precast base unit 12 so that the end wall 34 and the side walls 38, 40 of the precast riser unit 14 are placed on the bottom wall 22 of the precast base unit 12, inboard with respect to the stepped wall 24 of the precast base unit 12. As shown, the side wall 38 is spaced from the stepped wall 24 a desired amount. The end wall 34 and the other side wall 40 of the precast riser unit 14 are similarly spaced from the stepped wall 24 of the precast base unit 12. In a certain embodiment, a space of one inch is provided between an outer surface of the side wall 38 and an inner surface of the stepped wall 24. This space extends around the entire lengths of the end wall 34 and the side walls 38, 40. The space can be filled with a desired material suitable for securing the end wall 34 and the side walls 38, 40 of the precast riser unit 14 to the stepped wall 24 of the precast base unit 12. In one embodiment, grout or mortar material 62 can be used to fill the space.

To further secure and seal the precast riser unit 14 to the precast base unit 12, an adhesive 48 is disposed on the top surface 44 of the bottom wall 22 of the precast base unit 12, under the precast riser unit 14. In one embodiment, strips of butyl tape can be used as the adhesive 48; however, any suitable adhesive may be used.

A length of angle iron can be used to further secure the precast riser unit 14 to the precast base unit 12. As shown in FIG. 2, in one embodiment, three lengths of angle iron, each indicated at 50, can be used to secure the end wall 34 of the precast riser unit 14 to the precast base unit 12, and three lengths of angle iron 50 can be used to secure each side wall 38, 40 of the precast riser unit 14 to the precast base unit 12. In a certain embodiment, the lengths of each length of angle iron 50 can be two feet in length. As best shown in FIG. 6, the length of angle iron 50 is secured to the top surface 46 of the stepped wall 24 of the precast base unit 12 and the outwardly facing surface of the wall, e.g., wall 38, of the precast riser unit 14. In one embodiment, two fasteners suitable for concrete, each indicated at 52, can be used to secure the length of angle iron 50 to the stepped wall 24 of the precast base unit 12 and the wall 38 of the precast riser unit 14.

Figure 8:
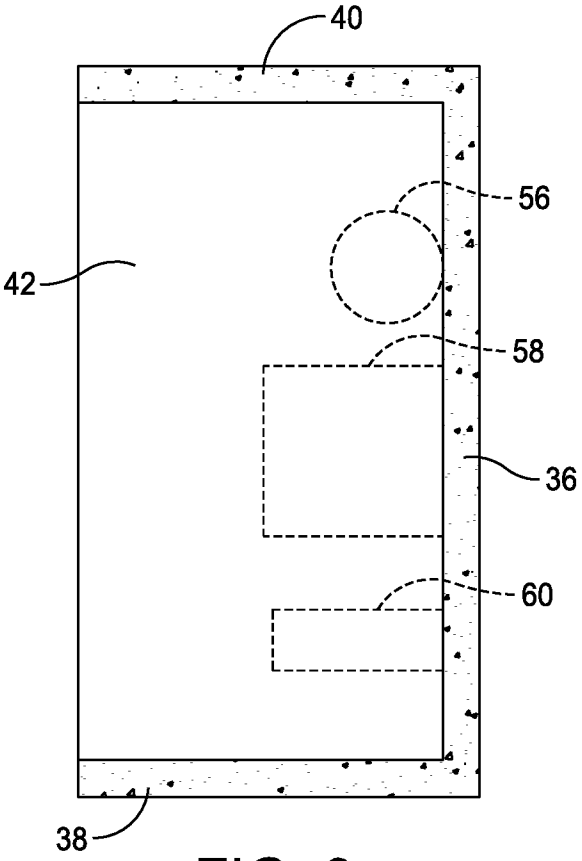
FIG. 8 is a top plan view of the horizontal shelf of the riser showing the equipment in dashed lines.
Figure 7:
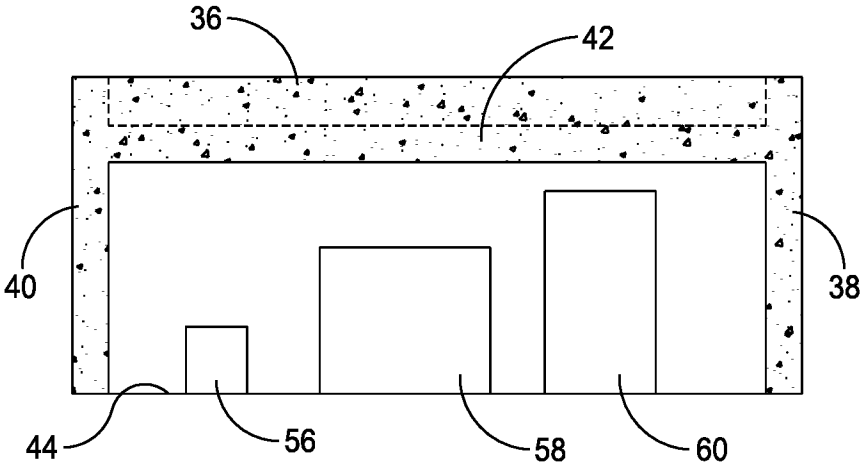
FIG. 7 is a back elevational view of a horizontal shelf of the riser showing equipment disposed in an area under the horizontal shelf.
Figure 9:
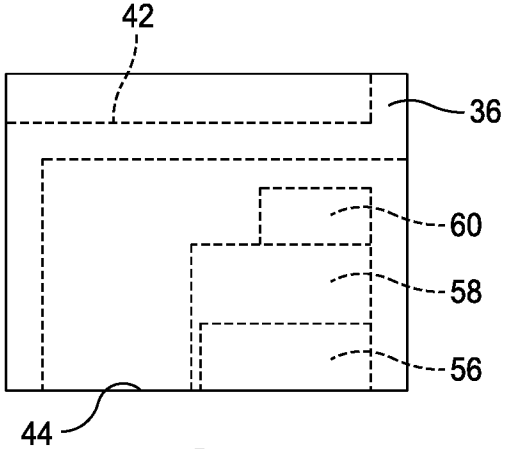
FIG. 9 is side elevational view of the horizontal shelf of the riser showing the horizontal shelf and the equipment in dashed lines.

Referring to FIGS. 7-9, the construction of the end wall 36 having the horizontal shelf 42 (bench 16) is shown. The horizontal shelf 42 embodies a horizontal structure that extends from the end wall 36, with the horizontal structure 42 being supported by a vertical structure 54 that extends within the modular plunge pool 10. In one embodiment, the horizontal shelf 42 extends along a plane that is three feet, two inches above the top surface 44 of the bottom wall 22 of the precast base unit 12. The space under the horizontal shelf 42 behind the vertical structure 54 can be used to accommodate pool equipment. As shown, in one embodiment, a pump 56, a heater 58, and a cartridge filter 60 can be located within this space. The vertical structure 54 may be configured to include the double step 18 and the top step 20 formed therein.

Figure 10:
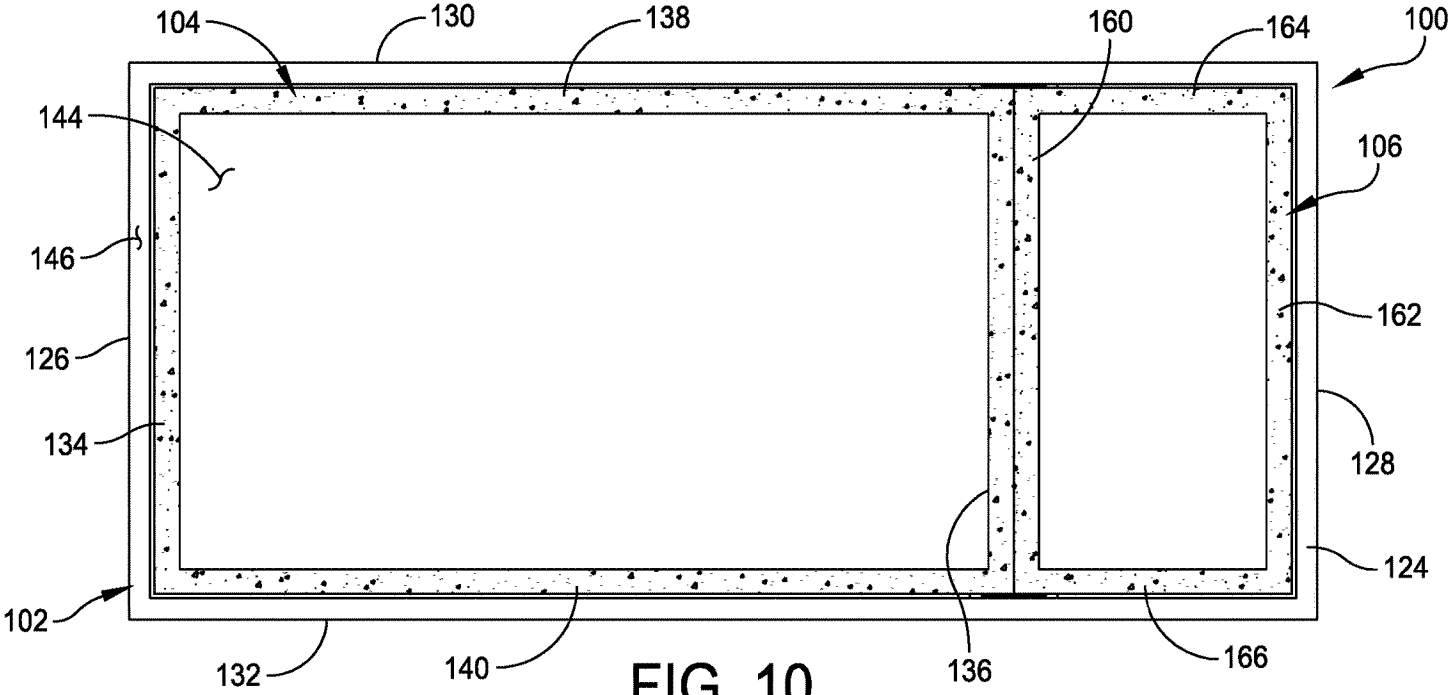
FIG. 10 is a top plan view of a modular plunge pool of another embodiment of the present disclosure.

Referring to FIGS. 10-13, and more particularly to FIG. 10, a modular plunge pool and hot tub of another embodiment of the present disclosure is generally indicated at 100. The modular plunge pool and hot tub 100 includes a precast base unit, generally indicated at 102, a precast riser pool unit, generally indicated at 104, that is supported on the precast base unit 102, and a precast riser hot tub unit, generally indicated at 106, that also is supported on the precast base unit 102. The precast base unit 102 and the precast riser pool unit 104 together define an interior volume of the plunge pool, which is configured to serve as a reservoir for containing water. Similarly, the precast base unit 102 and the precast riser hot tub unit 106 together define a smaller interior volume of a hot tub. Within the interior volume of the plunge pool, a variety of modular internal structures can be placed on the precast base unit 102.

As with the precast base unit 12 of the modular plunge pool 10, the precast base unit 102 of the modular plunge pool and hot tub 100 includes a bottom wall 122 that is generally planar. The precast base unit 102 further includes a stepped wall 124 that extends above the bottom wall 122. The size and shape of the precast base unit 102 defines the area of the modular plunge pool and hot tub 100, including the plunge pool and the hot tub. In one embodiment, the precast base unit 102 includes two ends 126, 128 and two longer sides 130, 132. In the shown embodiment, each end 126, 128 is eleven feet wide and each side 130, 132 is twenty-three feet, six inches long. However, the width and length of the precast base unit 102 can be selected based on a number of factors, including the area available for installation. In one embodiment, the bottom wall 122 of the precast base unit 102 has a thickness of six inches and the stepped wall 124 of the precast base unit 102 has a thickness of five inches. As noted, the thicknesses of the bottom wall 122 and the stepped wall 124 of the precast base unit 102 can be tailored to meet design needs.

The precast riser pool unit 104 and the precast riser hot tub unit 106 are sized and shaped to fit within the stepped wall 124 of the precast base unit 102. In one embodiment, the riser pool unit 104 includes two end walls 134, 136 and two longer side walls 138, 140. The precast riser pool unit 104 is designed to fit within the stepped wall 124 of the precast base unit 102, having a width of slightly less than ten feet and a length of slightly less than seventeen feet. In one embodiment, the end walls 134, 136 and the side walls 138, 140 each have a thickness of six inches. The precast riser hot tub unit 106 is also designed to fit within the stepped wall 124 of the precast base unit 102 adjacent to the precast riser pool unit 104. The precast riser hot tub unit 106 includes two end walls 160, 162 and two shorter side walls 164, 166. The precast riser hot tub unit 106 is designed to fit within the stepped wall 124 of the precast base unit 102 next to the precast riser pool unit 104, with the end walls 160, 162 each having a width of slightly less than ten feet and the side walls 164, 166 each having a length of slightly less than five feet, six inches.

The modular plunge pool and hot tub 100 is installed at a site by placing the precast base unit 102 in a hole that is dug into an area of ground at the intended installation site. The precast base unit 102 sits on the ground surface at a bottom of the hole. As shown, the precast base unit 102, in one embodiment, is rectangular in shape, having a length and width that are slightly larger than a width of the precast riser pool unit 104 and the precast riser hot tub unit 106 and a combined length of the precast riser pool unit 104 and the precast riser hot tub unit 106. When positioned, the precast riser pool unit 104 and the precast riser hot tub unit 106 are placed on top of the precast base unit 102. A seal is formed between the precast riser pool unit 104 and the precast base unit 102 so that the precast base unit 102 and the precast riser pool unit 104 together define the interior volume of the plunge pool. Similarly, a seal is formed between the precast riser hot tub unit 106 and the precast base unit 102 so that the precast base unit 102 and the precast riser hot tub unit 106 together define the interior volume of the hot tub.

As with modular plunge pool 10, a liner (not shown), such as a liner made of vinyl, tile, or plaster, can be placed within the interior volume of the plunge pool and the hot tub so that the liner covers the surfaces of the precast base unit 102, the precast riser pool unit 104, and the precast riser hot tub unit 106.

The manner in which the precast riser pool unit 104 and the precast riser hot tub unit 106 are secured to the precast base unit 102 is similar to how the precast riser unit 14 is secured to the precast base unit 12 of the modular plunge pool 10. The precast base unit 102 includes the bottom wall 122 having a top surface 144 on which the precast riser pool unit 104 and the precast riser hot tub unit 106 are received. The precast base unit 102 further includes the peripheral stepped wall 124 that extends upwardly from the bottom wall 122. The stepped wall 124 includes a top surface 146 that extends above the top surface 144 of the bottom wall 122. In one embodiment, the top surface 146 of the stepped wall 124 is four inches above the top surface 144 of the bottom wall 122.

The precast riser pool unit 104 and the precast riser hot tub unit 106 are positioned on the precast base unit 102 so that the end walls 134, 136 and the side walls 138, 140 of the precast riser pool unit 104 and the end walls 160, 162 and the side walls 164, 166 of the precast riser hot tub unit 106 are placed on the bottom wall 122 of the precast base unit 102, inboard with respect to the stepped wall 124 of the precast base unit 102. The end walls 134, 162 of the precast riser pool unit 104 and the precast riser hot tub unit 106, respectively, and the side walls 138, 140 of the precast riser pool unit 104 and the side walls 164, 166 of the precast riser hot tub unit 106 are spaced from the stepped wall 124 of the precast base unit 102 a desired amount. In a certain embodiment, a space of one inch is provided between outer surfaces of the end walls 134, 162 and the side walls 138, 140, 164, 166 and inner surfaces of the stepped wall 124. This space extends around the entire lengths of the end walls 134, 162 and the side walls 138, 140, 164, 166. The space can be filled with a desired material suitable for securing the end walls 134, 162 and the side walls 138, 140, 164, 166 to the stepped wall 124. In one embodiment, grout or mortar material, such as grout or mortar material 62 used for modular plunge pool 10, can be used to fill the space.

To further secure and seal the precast riser pool unit 104 and the precast riser hot tub unit 106 to the precast base unit 102, an adhesive, such as the adhesive 48 used in modular plunge pool 10, is disposed on the top surface 144 of the bottom wall 122 of the precast base unit, under the respective precast riser pool unit and the precast riser hot tub unit. As with modular plunge pool 10, strips of butyl tape can be used as the adhesive; however, any suitable adhesive may be used.

A length of angle iron, indicated at 150, can be used to further secure the precast riser pool unit 104 and the precast riser hot tub unit 106 to the precast base unit 102. In one embodiment, three lengths of angle iron 150 can be used to secure the end wall 134 of the precast riser pool unit 104 to the precast base unit 102, three lengths of angle iron 150 can be used to secure the end wall 162 of the precast riser hot tub unit 106 to the precast base unit 102, two lengths of angle iron 150 can be used to secure each side wall 138, 140 of the precast riser pool unit 104, and a single length of angle iron 150 can be used to secure each side wall 164, 166 of the precast riser hot tub unit 106. In a certain embodiment, the lengths of each length of angle iron 150 can be two feet in length. The length of angle iron 150 is secured to the top surface 146 of the stepped wall 124 of the precast base unit 102 and the outwardly facing surface of its respective wall of the precast riser pool unit 104 or the precast riser hot tub unit 106. In one embodiment, two fasteners suitable for concrete can be used to secure the length of angle iron 150 to the stepped wall 124 of the precast base unit 102 and the respective wall of the precast riser pool unit 104 or the precast riser hot tub unit 106.

Figure 11:
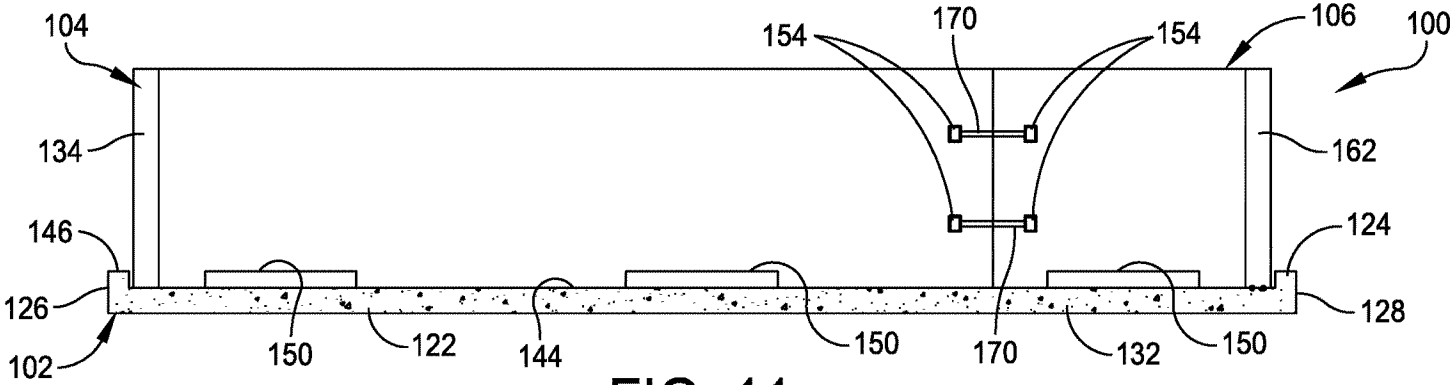
FIG. 11 is a side elevational view of the modular plunge pool shown in FIG. 10.

As shown in FIG. 11, bolt pockets, each indicated at 154, are formed in the outer surfaces of the side walls 138, 164 of the precast riser pool unit 104 and the precast riser hot tub unit 106, respectively. The bolt pockets 154 are used to secure the precast riser pool unit 104 to the precast riser hot tub unit 106. Bolts or metal strapping, each indicated at 170, can be used and secured to the precast riser pool unit 104 and the precast riser hot tub unit 106 to one another by the bolt pockets 154.

Figure 13:
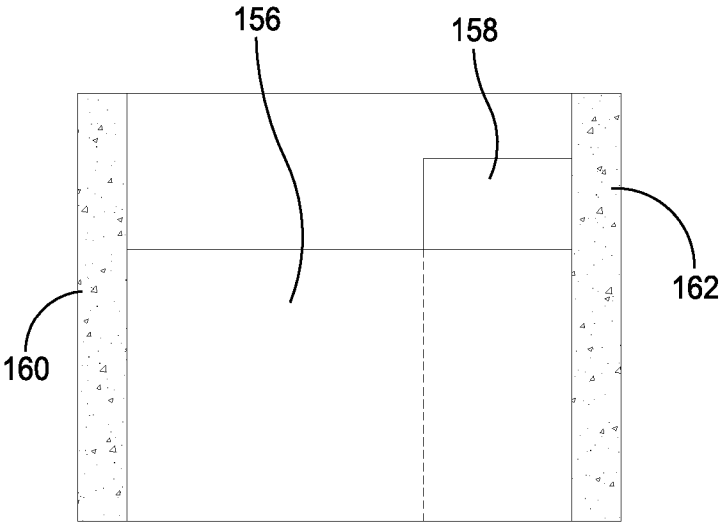
FIG. 13 is a cross-sectional view of the spa section of the modular plunge pool shown in FIGS. 10 and 11.
Figure 12:
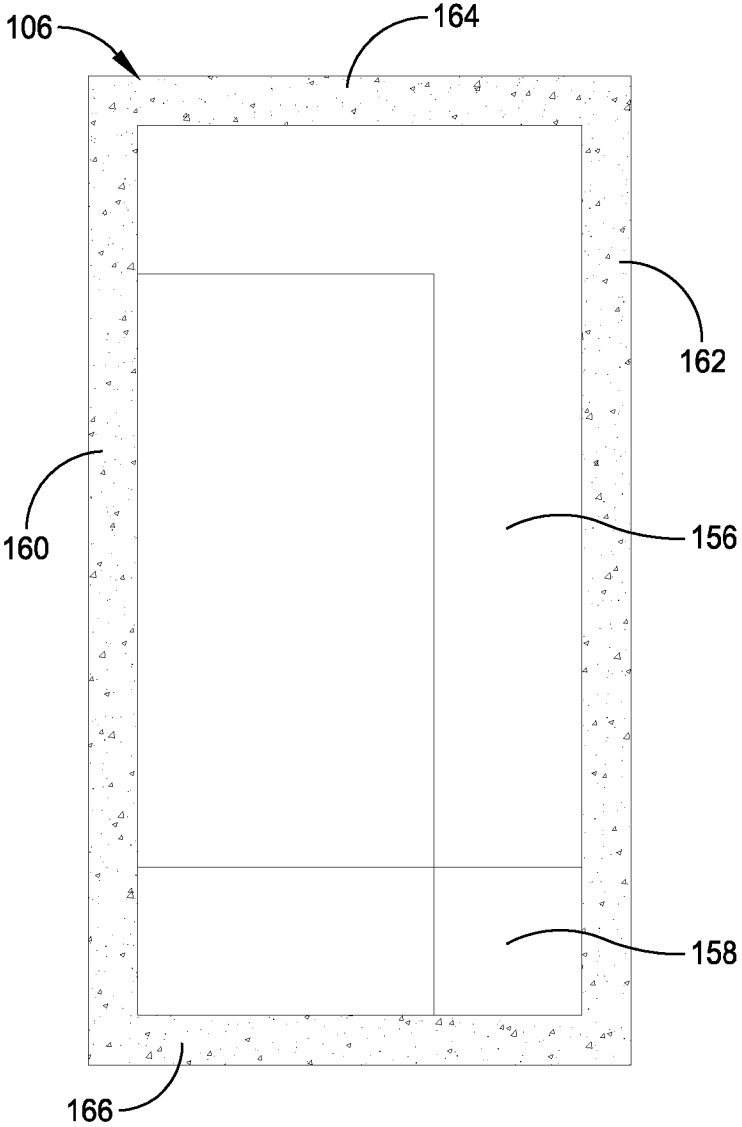
FIG. 12 is a top plan view of a spa section of the modular plunge pool shown in FIGS. 10 and 11.

Referring to FIGS. 12 and 13, the precast riser hot tub unit 106 can be configured to include one or more features. For example, the precast riser hot tub unit 106 can be configured to include a bench 156 that wraps around one side wall 164, the end wall 162, and the other side wall 166. The precast riser hot tub unit 106 further can include a step 158 positioned on the bench 156 at a corner of the end wall 162 and the side wall 166. Other configuration further can be provided.

Figure 14:
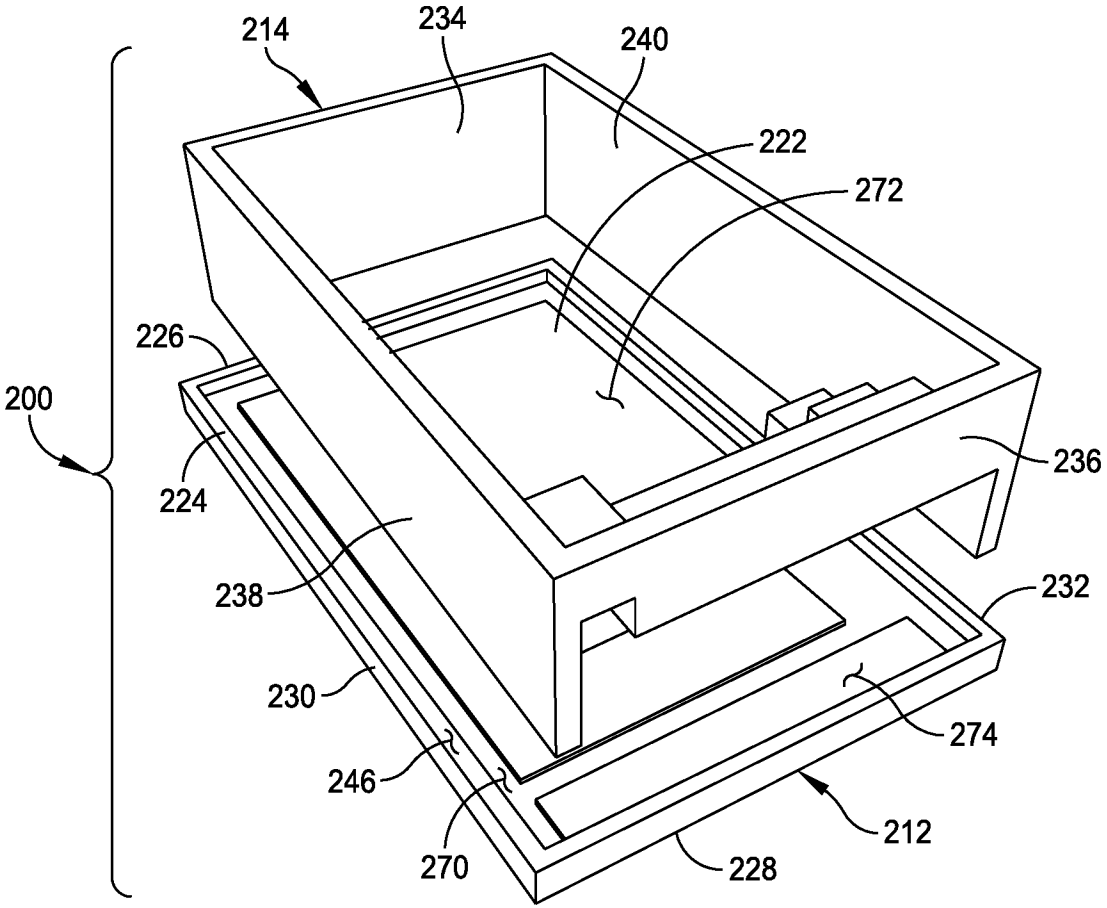
FIG. 14 is a perspective view of a modular plunge pool of another embodiment of the present disclosure.

Referring to FIG. 14, a modular plunge pool of another embodiment of the present disclosure is indicated at 200. As shown, the modular plunge pool 200 is substantially identical to the plunge pool 10, except for differences provided in a precast base unit. The modular plunge pool 200 includes a precast base unit, generally indicated at 212, and a precast riser unit, generally indicated at 214, that is supported on the precast base unit 212. Together the precast base unit 212 and the precast riser unit 214 define an interior volume of the modular plunge pool 200, which is configured to serve as a reservoir for containing water. Within the interior volume of the modular plunge pool 200, a variety of modular internal structures can be placed on the precast base unit 212, similar to the internal structures associated with modular plunge pool 10.

The precast base unit 212 includes a bottom wall 222 and a stepped wall 224 that extends above the bottom wall 222. The size and shape of the precast base unit 212 defines the area (width and length) of the modular plunge pool 200. In one embodiment, the precast base unit 212 includes two ends 226, 228 and two longer sides 230, 232. In the shown embodiment, each end 226, 228 is eleven feet wide and each side 230, 232 is eighteen feet long. In one embodiment, the bottom wall 222 has a thickness of six inches and the stepped wall 224 has a thickness of five inches. As will be noted in greater detail below, the thicknesses of the bottom wall 222 and the stepped wall 224 can be tailored to meet design needs.

The precast riser unit 214 is sized and shaped to fit within the stepped wall 224 of the precast base unit 212. Specifically, the precast riser unit 214 is sized and shaped to fit within the interior boundary defined by inner surfaces of the stepped wall 224 of the precast base unit 212. In one embodiment, the precast riser unit 214 includes a solid end wall 234, an opposite end wall 236, and two longer side walls 238, 240. As mentioned above, the precast riser unit 214 is designed to fit within the stepped wall 224 of the precast base unit 212. In the shown embodiment, each end wall 234, 236 has a width of slightly less than ten feet and each side wall has a length of slightly less than seventeen feet. In one embodiment, the end wall 234 and the side walls 238, 240 each have an inwardly facing surface and an outwardly facing surface, with a thickness of six inches.

The primary difference between the precast base unit 212 of the plunge pool 200 and the precast base unit 12 of the plunge pool 10 is the construction of the bottom wall 222 of the precast base unit 212. Specifically, the bottom wall 222 of the precast base unit 212 includes a lower surface 270 provided along the side 230, the end 226, and the opposite side 232 of the precast base unit 212. The bottom wall 222 of the precast base unit 212 further includes a first raised surface 272 that forms a bottom surface of the modular plunge pool 200 and a second raised surface 274 positioned adjacent to the end 228 of the precast base portion 212. As shown, the lower surface 270 extends between the first raised surface 272 and the second raised surface 274 in a direction that is parallel to the direction of the end 228 of the precast base portion 212.

The modular plunge pool 200 is installed at a site by placing the precast base unit 212 in a hole that is dug into an area of ground at the intended installation site. The precast base unit 212 sits on the ground surface at a bottom of the hole. When positioned, the precast riser unit 214 is placed on top of the precast base unit 212, with the side wall 238, the end wall 234, and the side wall 240 of the precast riser unit 214 being positioned inboard of the stepped wall 224 of the precast base unit 212 on the lower surface 270. As with modular plunge pool 10, a seal is formed between the precast base unit 212 and the precast riser unit 214 so that the precast base unit 212 and the precast riser unit 214 together define the interior volume of the modular plunge pool 200.

Figure 15:
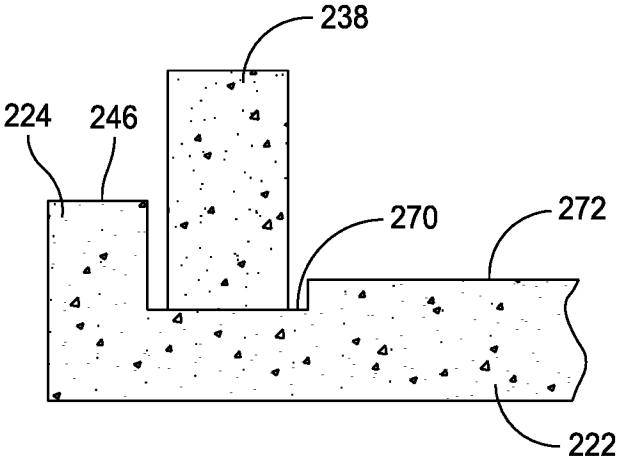
FIG. 15 is a cross-sectional view of a portion of the modular plunge pool shown in FIG. 14.

Referring to FIG. 15, the manner in which the precast riser unit 214 is secured to the precast base unit 212 is shown. As described above, the precast base unit 212 includes the bottom wall 222 having the lower surface 270 on which the precast riser unit 214 is placed. The precast base unit 212 further includes the peripheral stepped wall 224 that extends upwardly from the bottom wall 222 around the periphery of the bottom wall, e.g., ends 226, 228 and sides 230, 232. As shown, the stepped wall 224 includes a top surface 246 that extends above the lower surface 270 of the bottom wall 222. In one embodiment, the top surface 246 of the stepped wall 224 is four inches above the lower surface 270 of the bottom wall 222.

The precast riser unit 214 is positioned on the precast base unit 212 so that the end wall 234 and the side walls 238, 240 of the precast riser unit 214 are placed on the lower surface 270 of the bottom wall 222 of the precast base unit 212, inboard with respect to the stepped wall 224 of the precast base unit 212. As shown, the side wall 238 is spaced from the stepped wall 224 a desired amount. The end wall 234 and the other side wall 240 of the precast riser unit 214 are similarly spaced from the stepped wall 224 of the precast base unit 212. In a certain embodiment, a space of one inch is provided between an outer surface of the side wall 238 and an inner surface of the stepped wall 224. This space extends around the entire lengths of the end wall 234 and the side walls 238, 240. As with modular pool 10, the space can be filled with a desired material suitable for securing the end wall 234 and the side walls 238, 240 of the precast riser unit 214 to the stepped wall 224 of the precast base unit 212.

As further shown in FIG. 15, the first raised surface 272 is above the lower surface 270 of the precast base unit 212. In one embodiment, the first raised surface 272 is one and one half inch above the lower surface 270. The arrangement is such that the lower surface 270 as defined between the stepped wall 224 and the first and second raised surfaces 272, 274 define a seat on which the walls 234, 236, 238, 240 of the precast riser unit 214 rest. To further secure and seal the precast riser unit 214 to the precast base unit 212, an adhesive, similar to adhesive 48 for modular plunge pool 10, may be disposed on the lower surface 270 of the bottom wall 222 of the precast base unit 212, under the precast riser unit 214. Further, a length of angle iron can be used to further secure the precast riser unit 214 to the precast base unit 212 in the same manner in which the lengths of angle iron 50 are used to secure the precast riser unit 14 to the precast base unit 12 of modular plunge pool 10.

It should be observed that the seat defined by the lower surface 270 of the precast base unit 212 between the stepped wall 224 and the first and second raised surfaces 272, 274 facilitates the positioning of the precast riser unit 214 on the precast base unit 212.

A method of installing the modular plunge pool 10 is further disclosed. With one method, a hole suitable to receive the precast base unit 12 is dug at a desired location for the modular plunge pool 10. The precast base unit 12 is seated on a recessed surface dug into an area of ground at the installation site. Next, adhesive 48, such as strips of butyl tape, is installed on the precast base unit 12 on the top surface 44 of the bottom wall 22 of the precast base unit where the precast riser unit 14 is positioned. Next, for modular plunge pool 10, the precast riser unit 14 is lowered onto the precast base unit 12. The adhesive 48 seals the precast riser unit 14 to the precast base unit 12. Next, grout or mortar material 62 is deposited in the space provided between the walls of the precast riser unit 14 and the stepped wall 24 of the precast base unit 12. Next, lengths of angle iron 50 are secured to the precast base unit 12 and the precast riser unit 14 at desired locations around a periphery of the modular plunge pool 10. Optionally, equipment can be installed under the horizontal shelf 42 of the precast riser unit 14.

For modular plunge pool 100, the precast riser pool unit 104 and the rider hot tub unit 106 are lowered onto the precast base unit 102. Next, grout is deposited in the space provided between the walls of the precast riser pool unit 104 and the precast riser hot tub unit 106 and the stepped wall 124 of the precast base unit 102. Next, lengths of angle iron 150 are secured to the precast base unit 102 and the precast riser pool unit 104 and the precast riser hot tub unit 106 at desired locations around a periphery of the modular plunge pool 100. Optionally, bolts or metal straps 170 can be secured to the precast riser pool unit 104 and the precast riser hot tub unit 106 by the bolt pockets 154.

The method may include adding a liner that extends over the internal surfaces of the precast riser unit.

The method may include forming the precast base unit and/or the precast riser unit at remote locations.

The method may include using at least one blank to form at least one port on the precast riser unit in fluid communication with the interior of the pool. In some embodiments, the port is a skimmer port. In some embodiments, port is a channel that is configured to be connected to external piping.

In some embodiments, the stepped wall or curb is located around a perimeter of the precast riser unit to prevent the precast riser unit from moving or shifting outwardly.

In some embodiments, the lengths of angle iron secured to the precast base unit and the precast riser unit prevent the precast riser unit from moving or shifting inwardly.

In some embodiments, the steeped wall or curb provides flotation resistance for installations with a high water table. Friction caused by the extended stepped wall or curb prevents the modular plunge pool from moving upwardly out of the ground.

In some embodiments, the stepped wall functions as a brick shelf to eliminate the need to pour a supporting slab for brick or stone.

In some embodiments, due to steps and benches being poured as part of the precast riser unit, an interior finish can be installed prior to installing the modular plunge pool. A joint where the precast riser unit and the precast base unit meet can be finished in the field in a much shorter time than if the entire interior finish were to be applied in the field, as is the case with existing plunge pool designs.

In some embodiments, by pouring the steps and benches with the precast riser unit, the precast riser unit is much stronger than prior designs having only four walls.

In some embodiments, by sealing the precast riser unit to the precast base unit with grout disposed between the one-inch space between the walls of the precast riser unit and the stepped wall of the precast base unit, leakage is significantly reduced or prevented.

In some embodiments, a void under the stairs of the precast riser unit can be filled with foam insulation to make the modular plunge pool more energy efficient.

In some embodiments, the design of the precast base unit enables the insertion of several modular add-ons, including a hot tub unit or horizontal shelf without the need for an additional supporting concrete structure.

In some embodiments, the stepped wall or curb is much stronger than prior designs.

In some embodiments, siding panels, such as wood siding panels, can be placed around a portion of an exterior surface of the precast riser unit that extend above the ground.

In some embodiments, an upper edging (coping) structure can be placed over an upper ends of the walls of the precast riser unit to provide a desired aesthetic appearance of the fully assembled modular plunge pool.

In some embodiments, embodiments of modular plunge pools of the present disclosure can be made with various dimensions.

In some embodiments, the precast riser units and the precast base units can be fabricated from precast concrete and include rebar to reinforce the concrete.

In some embodiments, internal modular units can be placed within the interior volume defined by the precast base unit and the precast riser unit. The internal modular units are precast and can be arranged within the interior volume of the pool structure as desired by a user prior to installation or after installation. The internal modular units can sit directly on the upper surface of the precast base unit and/or on top of other internal modular units. In some embodiments, the internal modular units can be secured to the upper surface of the precast base unit. For example, in some embodiments, the internal modular units are secured to the upper surface of the precast base unit by mortar.

One or more benches or other modular platforms can be positioned in the pool to achieve desired internal features in the pool. For example, the height of the bench can be selected to create a shallow area in the pool that can be used as a built in lounge area, an area for sunning, or an area for small children to play in shallow water.

In some embodiments, a modular plunge pool assembly includes two or more of the modular plunge pools described above that are positioned adjacent to each other, with each modular plunge pool having an opening defined in one of its side walls so water may flow between the modular plunge pools. In some embodiments, a modular plunge pool assembly includes two modular plunge pools described above that are positioned adjacent to each other, with a first opening in a first one of the modular plunge pools being aligned with a second opening in a second one of the modular plunge pools so water may flow between the first modular plunge pool and the second modular plunge pool.

Having thus described several aspects of at least one embodiment of this disclosure, it is to be appreciated various alterations, modifications, and improvements will readily occur to those skilled in the art. Such alterations, modifications, and improvements are intended to be part of this disclosure, and are intended to be within the spirit and scope of the disclosure. Accordingly, the foregoing description and drawings are by way of example only.

What is claimed is:

1. A modular plunge pool comprising:

a precast base unit including a bottom wall having a first top surface and at least one stepped wall provided on a periphery of the bottom wall, the at least one stepped wall having a second top surface disposed above the first top surface of the bottom wall a predetermined distance, the precast base unit further including a lower surface disposed below the first top surface of the bottom wall and below the second top surface of the at least one stepped wall, the first top surface being disposed below the second top surface; and a precast riser unit separate from the precast base unit, the precast riser unit having at least one wall that extends vertically, wherein the precast riser unit, when secured to the precast base unit, is configured so that the at least one wall of the precast riser unit is inboard with respect to the at least one stepped wall of the precast base unit, and wherein the lower surface of the precast base unit defines a seat on which the at least one wall of the precast riser unit rests.

2. The modular plunge pool of claim 1, further comprising an adhesive positioned on the first top surface of the precast base unit where the precast riser unit is secured.

3. The modular plunge pool of claim 2, wherein the adhesive is butyl tape.

4. The modular plunge pool of claim 2, further comprising at least one fastener configured to secure the at least one wall of the precast riser unit to the stepped wall of the precast base unit.

5. The modular plunge pool of claim 4, wherein the at least one fastener includes a length of angle iron secured to the second top surface of the at least one stepped wall of the precast base unit and an outwardly facing surface of the at least one wall of the precast riser unit.

6. The modular plunge pool of claim 1, wherein the at least one stepped wall of the precast base unit includes three stepped walls, and the at least one wall of the precast riser unit includes three walls, the three stepped walls of the precast base unit corresponding to the three walls of the precast riser unit.

7. The modular plunge pool of claim 6, further comprising an adhesive positioned on the first top surface of the precast base unit where the three walls of the precast riser unit are secured.

8. The modular plunge pool of claim 7, further comprising a plurality of fasteners configured to secure the three walls of the precast riser unit to the respective three stepped walls of the precast base unit.

9. The modular plunge pool of claim 8, wherein the plurality of fasteners each include, for each stepped wall of the precast base unit and the respective wall of the precast riser unit, a length of angle iron secured to the second top surface of the stepped wall of the precast base unit and an outwardly facing surface of the respective wall of the precast riser unit.

10. The modular plunge pool of claim 6, wherein the precast riser unit further includes a horizontal shelf secured to side walls of the three walls of the precast riser unit, the horizontal shelf being disposed above the top surface of the bottom wall of the precast base unit a predetermined distance.

11. A method of assembling the modular plunge pool of claim 1, the method comprising:

delivering the precast base unit and the precast riser unit to an installation site;

positioning the precast base unit at the installation site; and securing the precast riser unit to the precast base unit so that the precast base unit and the precast riser unit define an interior of the modular plunge pool.

12. The method of claim 11, further comprising installing adhesive on the precast base unit on the top surface of the precast base unit where the precast riser unit is positioned.

13. The method of claim 11, further comprising depositing grout in a space provided between the at least one wall of the precast riser unit and the at least one stepped wall of the precast base unit.

14. The method of claim 11, further comprising securing at least one length of angle iron to the precast base unit and the precast riser unit at a desired location.

15. The method of claim 11, further comprising installing equipment under a horizontal shelf of the precast riser unit.

16. A modular plunge pool and hot tub, comprising:

a precast base unit including a bottom wall having a first top surface and at least one stepped wall provided on a periphery of the bottom wall, the at least one stepped wall of the precast base unit including four stepped walls, the at least one stepped wall having a second top surface disposed above the first top surface of the bottom wall a predetermined distance;

a precast riser pool unit separate from the precast base unit, the precast riser pool unit having at least one plunge pool wall that extends vertically, the at least one plunge pool wall of the precast riser pool unit including four plunge pool walls, at least three stepped walls of the four stepped walls of the precast base unit corresponding to at least three plunge pool walls of the four plunge pool walls of the precast riser pool unit; and a precast riser hot tub pool unit separate from the precast base unit and the precast plunge pool unit, the precast hot tub unit having at least one hot tub wall that extends vertically, the at least one hot tub wall of the precast riser hot tub unit including four hot tub walls, at least three stepped walls of the four stepped walls of the precast base unit corresponding to at least three hot tub walls of the four hot tub walls of the precast riser hot tub unit, wherein each of the precast riser pool unit and the precast riser hot tub unit, when secured to the precast base unit, is configured so that the at least one plunge pool wall of the precast riser pool unit and the at least one hot tub wall of the precast riser hot tub unit are inboard with respect to the at least one stepped wall of the precast base unit.

17. The modular plunge pool and hot tub of claim 16, further comprising an adhesive positioned on the first top surface of the precast base unit where the precast riser pool unit and the precast riser hot tub unit are secured.

18. The modular plunge pool and hot tub of claim 17, further comprising at least one fastener configured to secure the at least one wall of the precast riser unit to the stepped wall of the precast base unit.

19. The modular plunge pool and hot tub of claim 18, wherein the at least one fastener includes a length of angle iron secured to the second top surface of the at least one stepped wall of the precast base unit and an outwardly facing surface of the at least one wall of the precast riser unit.

20. The modular plunge pool and hot tub of claim 16, further comprising an adhesive positioned on the first top surface of the precast base unit where the at least three plunge pool walls of the precast riser pool unit and the at least three hot tub walls of the precast riser hot tub unit are secured, and a plurality of fasteners configured to secure the at least three plunge pool walls of the precast riser pool unit to the respective three stepped walls of the precast base unit and to secure the at least three hot tub walls of the precast hot tub unit to the respective three stepped walls of the precast base unit.

* * * * *